US010518925B2

(12) United States Patent
Kunihiro et al.

(10) Patent No.: US 10,518,925 B2
(45) Date of Patent: Dec. 31, 2019

(54) MOLDED PAPER BODY WITH MINIMAL WRINKLING AND FORMING METHOD THEREOF

(71) Applicants: TOYO SEIKAN GROUP HOLDINGS, LTD., Tokyo (JP); TOKAN KOGYO CO., LTD., Tokyo (JP)

(72) Inventors: Ichiro Kunihiro, Yokohama (JP); Seiji Okabe, Tokyo (JP)

(73) Assignees: TOYO SEIKAN GROUP HOLDINGS, LTD., Tokyo (JP); TOKAN KOGYO CO., LTD., Tokyo (JP)

( * ) Notice: Subject to any disclaimer, the term of this patent is extended or adjusted under 35 U.S.C. 154(b) by 1270 days.

(21) Appl. No.: 14/349,794

(22) PCT Filed: Oct. 2, 2012

(86) PCT No.: PCT/JP2012/075545
§ 371 (c)(1),
(2) Date: Apr. 4, 2014

(87) PCT Pub. No.: WO2013/051573
PCT Pub. Date: Apr. 11, 2013

(65) Prior Publication Data

US 2014/0255630 A1 Sep. 11, 2014

(30) Foreign Application Priority Data

Oct. 7, 2011 (JP) ..... 2011-222809

(51) Int. Cl.
*B65D 1/26* (2006.01)
*B31B 50/59* (2017.01)
(Continued)

(52) U.S. Cl.
CPC ..... *B65D 1/265* (2013.01); *B31B 50/592* (2018.05); *B31B 2105/00* (2017.08);
(Continued)

(58) Field of Classification Search
CPC ..... B65D 1/0261; B65D 1/265; B65D 13/04; B65D 1/26; B65D 1/165; B31B 50/44;
(Continued)

(56) References Cited

U.S. PATENT DOCUMENTS 1,468,146 A * 9/1923 Feybusch, et al. ..... B31B 70/00 493/334
1,574,564 A * 2/1926 Farnsworth ..... B31B 70/00 425/293
(Continued)

FOREIGN PATENT DOCUMENTS

DE 1167640 B 4/1964
FR 897286 A 3/1945
(Continued)

OTHER PUBLICATIONS

International Search Report, dated Dec. 11, 2012, issued in corresponding application No. PCT/JP2012/075545.
(Continued)

*Primary Examiner* — Robert F Long
*Assistant Examiner* — Eduardo R Ferrero
(74) *Attorney, Agent, or Firm* — Westerman, Hattori, Daniels & Adrian, LLP

(57) ABSTRACT

The objective of the present invention is to provide a molded paper body in which the outer peripheral portion of a blank primarily of paper is formed in a raised shape using draw processing, wherein the molded paper body eliminates the occurrence of wrinkles causing leaking or instability of adhesion when used as the bottom member of a paper cup or similar paper container and a forming method thereof. The
(Continued)

method for manufacturing this molded paper body is to draw-process, with a punch and die, a single blank primarily of paper, and is characterized by use of a holding mechanism to press the outer peripheral portion of the blank between a wrinkle pressing member and the die upper surface, and setting the force applied by the wrinkle pressing member within an appropriate range.

5 Claims, 9 Drawing Sheets

(51) Int. Cl.
*B31B 105/00* (2017.01)
*B31B 110/10* (2017.01)
*B31B 110/20* (2017.01)

(52) U.S. Cl.
CPC ... *B31B 2105/0022* (2017.08); *B31B 2110/10* (2017.08); *B31B 2110/20* (2017.08); *Y10T 428/1303* (2015.01)

(58) Field of Classification Search
CPC ..... B31B 50/59; B31B 50/26; B31B 50/0012; B31B 2120/00; B31B 2105/00; B31B 2105/0022; B31B 50/592; B31B 2110/10; B31B 2110/20; B31D 1/005; B31D 5/02; Y10T 428/1303
See application file for complete search history.

(56) References Cited

U.S. PATENT DOCUMENTS 1,966,469 A * 7/1934 Taylor ..... B31B 70/00 264/316
1,975,150 A * 10/1934 Henry ..... B31B 70/00 493/74
2,121,951 A * 6/1938 Clark ..... B31B 70/00 215/316
2,832,522 A 4/1958 Schlanger
3,408,902 A 11/1968 Voe
3,695,084 A * 10/1972 Siemonsen ..... B21D 51/10 72/348
3,732,836 A * 5/1973 Molloy ..... B21D 53/12 29/898.066
4,070,953 A 1/1978 Richards et al.
4,228,121 A * 10/1980 Meadors ..... B29C 51/082 264/291
4,425,778 A * 1/1984 Franek ..... B21D 22/30 72/347
4,514,353 A * 4/1985 Alexander ..... B29C 51/30 264/294
4,534,725 A * 8/1985 Hemmelgarn ..... B31B 70/00 249/134
4,554,127 A * 11/1985 Hain ..... B31F 1/0077 264/324
4,576,566 A * 3/1986 Hain ..... B31F 1/0077 425/384
4,606,496 A * 8/1986 Marx ..... B65D 1/34 220/574
4,609,140 A * 9/1986 Van Handel ..... A47G 19/03 220/574
4,721,500 A * 1/1988 Van Handel ..... A47G 19/03 493/152
4,778,439 A * 10/1988 Alexander ..... B29C 51/082 264/322
4,832,676 A * 5/1989 Johns ..... B31F 1/0077 264/320
5,083,449 A * 1/1992 Kobayashi ..... B21D 22/22 72/349
5,083,699 A * 1/1992 Bulcher ..... B65D 1/34 229/125.17
5,111,679 A * 5/1992 Kobayashi ..... B21D 22/30 72/347
5,209,099 A * 5/1993 Saunders ..... B21D 22/201 72/349
5,326,020 A * 7/1994 Cheshire ..... A47G 19/03 229/407
5,778,722 A * 7/1998 Saiki ..... B21D 22/28 72/347
5,904,643 A * 5/1999 Seeberger ..... B31B 70/00 425/351
6,099,924 A * 8/2000 Nakamaki ..... B32B 27/36 428/220
6,135,936 A 10/2000 Brown et al.
6,244,091 B1 * 6/2001 McClung ..... B21D 22/22 72/347
6,264,100 B1 7/2001 Brown et al.
6,527,687 B1 3/2003 Fortney et al.
7,819,790 B2 * 10/2010 Grischenko ..... B31B 70/00 100/215
8,430,660 B2 * 4/2013 Johns ..... B29C 43/36 425/193
2002/0012759 A1 * 1/2002 Asayama ..... B31F 1/0077 428/34.2
2003/0021921 A1 * 1/2003 Debraal ..... B32B 27/10 428/34.2
2003/0026930 A1 * 2/2003 Ferri ..... B31F 1/0077 428/36.9
2003/0173366 A1 * 9/2003 Littlejohn ..... A47G 19/03 220/574
2003/0183968 A1 * 10/2003 Johns ..... B29C 43/36 264/40.6
2003/0205848 A1 * 11/2003 Johns ..... B29C 43/36 264/320
2004/0069788 A1 * 4/2004 Johns ..... B65D 1/36 220/575
2006/0278357 A1 * 12/2006 Suzuki ..... B31F 1/07 162/117
2007/0042887 A1 * 2/2007 Johns ..... B31B 43/00 493/143
2008/0124421 A1 * 5/2008 Johns ..... B29C 45/4005 425/422
2008/0193687 A1 * 8/2008 Asayama ..... B65D 1/34 428/34.2
2009/0223952 A1 * 9/2009 Wnek ..... B65D 1/34 219/730
2011/0117374 A1 * 5/2011 Cho ..... D21H 19/32 428/452
2011/0195829 A1 * 8/2011 Treccani ..... B31F 1/0077 493/174
2012/0118880 A1 * 5/2012 Wnek ..... B31B 1/00 219/725
2012/0184421 A1 * 7/2012 Clougherty ..... B26F 1/44 493/58
2013/0064998 A1 * 3/2013 Wnek ..... B21D 22/26 428/34.1
2013/0092312 A1 * 4/2013 Cassoni ..... B31B 50/00 156/69

FOREIGN PATENT DOCUMENTS

JP 11-057906 A 3/1999
JP 2000-238150 A 9/2000
JP 2001-270013 A 10/2001
JP 2001-524403 A 12/2001
JP 2004-017408 A 1/2004
JP 2004-154959 A 6/2004
JP 4121832 B2 7/2008

OTHER PUBLICATIONS

Search Report dated Apr. 13, 2015, issued in counterpart European Application No. 12 838 658.8 (4 pages).

* cited by examiner

MOLDED PAPER BODY WITH MINIMAL WRINKLING AND FORMING METHOD THEREOF

TECHNICAL FIELD

The present invention relates to a molded paper body with minimal wrinkling, a production method thereof, and a paper container having a body member and a bottom member produced by the method.

BACKGROUND ART

Molded paper bodies have hitherto been universally used in various forms of containers in the field of packaging and containers. There are one-piece molded paper bodies such as paper trays or paper dishes, and there are two-piece paper containers formed of a body member and a bottom member.

Molded paper bodies formed by deep drawing a blank that is mainly made of paper lack malleability and ductility unlike metals and the blank tends to wrinkle in upright portions along the periphery during the process. FIG. 10 shows a two-piece paper container consisting of a bottom member X and a body member Y. The bottom member (Molded paper body) is formed by deep drawing. The following methods have been disclosed as techniques to reduce wrinkles in molded paper bodies.

Patent Document 1 discloses a method of deep drawing for producing pressed paper containers wherein a flange press and a die upper surface are kept a constant distance from each other to enable deep drawing with minimal wrinkling. Patent Document 2 aims at providing a bottom piece for paper cups that can make favorable tight contact with the body member and discloses a method wherein an outer peripheral portion of the bottom piece is pressed from above. Patent Document 3 aims at providing a bottom piece for paper cups that has pleats (wrinkles) not so large as to be folded and discloses a deep drawing method wherein the gap between a drawing part (punch) and an opening (die) is made smaller than the thickness of the paper stock (blank).

Patent Document 1: Japanese Patent No. 4121832 "Method and apparatus for producing molded container and molded container" registered on May 9, 2008 and issued on Jul. 23, 2008

Patent Document 2: Japanese Patent Application Laid-open No. 2001-270013 "Apparatus and method for forming bottom paper sheet of paper cup" published on Oct. 2, 2001

Patent Document 3: Japanese Patent Application Laid-open No. 2000-238150 "Paper cup bottom and method and apparatus for forming same", published on Sep. 5, 2000

DISCLOSURE OF THE INVENTION

For the molded paper bodies made by conventional methods, various techniques have been proposed such as forming small wrinkles so as to form readily crushable folded parts, or inserting the paper blank into a gap that is smaller than the thickness of the blank during the deep drawing to crush small wrinkles and to make them less notable. However, none of these processes has been proven effective to completely eliminate wrinkles.

Paper containers used in the field of food and drink containers for a longer term than a normal storage period, i.e., long-life containers, are generally sterilized with the use of a pharmaceutical agent. Containers processed to have wrinkles in the side wall of the bottom member will have gaps or pockets near the joint between the side wall of the bottom member and the body member on the side that contacts the contents, and this results in preventing a pharmaceutical agent from reaching all parts of the container and causes a problem such as insufficient sterilization, or leakage of contents. Molded paper bodies and a forming method thereof that can solve these problems are thus sought after.

To solve the problems described above, the present invention aims at providing a molded paper body, a paper container using the same, and a forming method thereof. An object of the invention, firstly, is to provide a molded paper body that has a smooth surface and favorable appearance, and, secondly, to provide a molded paper body having good adhesion with a body member.

The method of producing a molded paper body according to the present invention involves deep drawing a sheet of blank composed mainly of paper with a punch and a die, and uses a mechanism of holding by pressing an outer peripheral portion of the blank with a wrinkle pressing member and a die top surface, wherein the pressure applied by the wrinkle pressing member is set, based on a characteristic relation of the die between a proportion of the wrinkle pressing force relative to the blank tensile strength, and a wrinkling starting height, to equal to or above a value of proportion of the wrinkle pressing force, with which wrinkling starting height exceeds a threshold ω, and also set to a proportion at 12% or lower, where ωa height, at or below which no wrinkling occurs, and which is determined during production.

The die that engages with the punch has a rounded distal end shape, with a radius of curvature R being 2.5 t to 6 t, where t is the thickness of the blank.

The pressure is applied by the wrinkle pressing member that is at a predetermined distance from the upper surface of the die and at a predetermined pressure.

In one embodiment of the present invention, the distance between a distal end face of the wrinkle pressing member and the die upper surface is set to a predetermined value d that is equal to or smaller than the original thickness t of the blank, the distance being variable in accordance with an increase in thickness of the outer peripheral portion of the blank during deep drawing so as to prevent excessive pressure from being applied.

In another embodiment, the distance between the distal end face of the wrinkle pressing member and the die upper surface is set to a predetermined value d that is equal to or larger than the thickness t of the blank, the distance being variable in accordance with an increase in thickness of the outer peripheral portion of the blank in the middle of implementing deep drawing so as to prevent excessive pressure from being applied.

In one embodiment of the method of producing a molded paper body according to the present invention, in addition to the structure described above, the die has an approach angle of 0.1° to 5°, and a clearance CL between an inner circumferential surface of the die and an outer circumferential surface of the punch is set so as to achieve an ironing rate (red), expressed as $\{(t-CL)/t\}\times 100$, of 20 or less, in performing the deep drawing and ironing.

The outer circumferential surface continuing to the distal end of the punch is tapered to provide a relief so that the outer peripheral edge of the blank is not ironed.

A molded paper body according to the present invention is formed by deep drawing a blank composed mainly of paper to make an outer peripheral portion of the blank stand up thereby forming a wall portion by the forming method described above, wherein hollows in a horizontal cross section of the wall portion have a dimension of 30% or less with respect to a 100% base paper thickness of the blank upright at or below a dimension threshold ωfrom a bottom part.

The paper container according to the present invention is a two-piece container having a bottom member that is the molded paper body described above and a body member and suitable for long-life applications.

With the method of producing a molded paper body according to the present invention, the pressure applied by the wrinkle pressing member is set, based on a characteristic relation of the die between a proportion of the wrinkle pressing force relative to the blank tensile strength, and a wrinkling starting height, to at least a value of proportion of the wrinkle pressing force, with which wrinkling starting height exceeds a threshold ω, and also set to a proportion at 12% or lower so that hollows in a horizontal cross section of a wall portion of the resultant molded paper body have a dimension of 30% or less with respect to a 100% base paper thickness of the blank upright at or below the height ωfrom the bottom. Thus the resultant molded paper body has a smooth surface without any distinctly visible wrinkles in the deep drawn portion.

Furthermore, with the method of producing a molded paper body according to the present invention, the effect described above can be achieved even more reliably with the die that engages with the punch with a rounded distal end shape, with a radius of curvature R being 2.5 t to 6 t, where t is the thickness of the blank.

Furthermore, with the method of producing a molded paper body according to the present invention, the effect described above can be achieved even more reliably with the die that engages with the punch with a rounded distal end shape, with a radius of curvature R being 2.5 t to 6 t, where t is the thickness of the blank.

The method of producing a molded paper body according to the present invention is realized with such simple means of applying pressure as the wrinkle pressing member staying at a constant distance from the upper surface of the die and applying a constant pressure.

A predetermined level of pressure can be applied stably in an initial stage of the process by setting the distance between a distal end face of the wrinkle pressing member and the die upper surface to a predetermined value d that is smaller than the original paperboard thickness t of the blank.

The pressing force may be adjusted by changing the distance in accordance with an increase in thickness of the outer peripheral portion of the blank during deep drawing so as to prevent rupture of the blank due to excessive pressure being applied thereon. With such a mechanism, the distance between the distal end face of the wrinkle pressing member and the die upper surface can even be set to a predetermined value d that is equal to or larger than the original paperboard thickness of the blank, and yet the blank can be processed as desired.

With the method of producing a molded paper body according to the present invention, the die has an approach angle of 0.1° to 5°, and a clearance CL between an inner circumferential surface of the die and an outer circumferential surface of the punch is set such as to achieve an ironing rate (red) expressed as $\{(t-CL)/t\}\times 100$ of 20 or less, to reduce springback of the blank and give it a shape retaining property.

The outer circumferential surface continuing from the distal end of the punch is tapered to provide a relief so that the outer peripheral edge of the blank will not be ironed, whereby scattering of fine paper powder is prevented.

The molded paper body according to the present invention produced under the conditions described above has hollows in a horizontal cross section of the wall portion of a dimension of 30% or less with respect to a 100% original thickness of the blank upright at or below the height ωfrom the bottom, so that the resultant molded paper body has a smooth surface without any distinctly visible wrinkles in the deep drawn portion.

A paper container according to the present invention, which is a two-piece container having a bottom member that is the molded paper body described above and a body member, can be used for long-life applications without the problems of remnant disinfectant, lowered oxygen barrier property and moisture proofness, leakage of content, and the like, as the bottom member with the smooth surface is bonded tightly to the body member.

EXPLANATION OF REFERENCE NUMERALS

Figure 1:
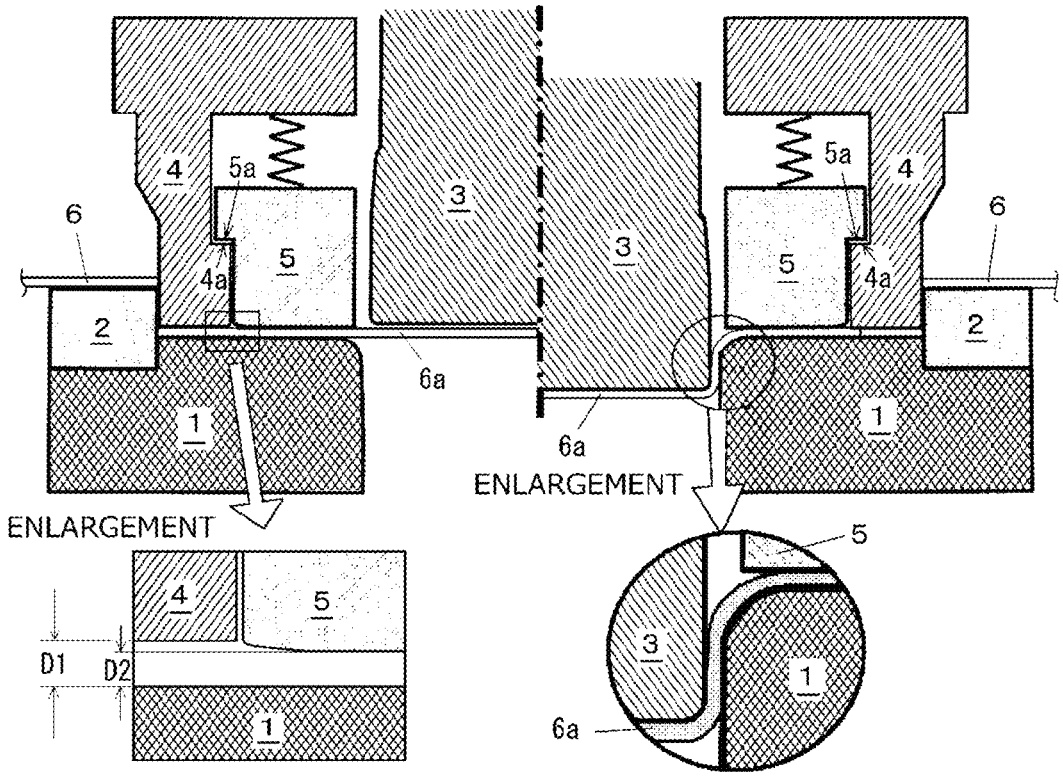
FIG. 1 is a diagram illustrating the configuration for carrying out a method of producing a molded paper body in one embodiment of the present invention.

1: deep drawing and ironing die
2: blanking die
3: deep drawing and ironing punch
4: blanking punch
4*a*: stepped portion of blanking die
5: wrinkle pressing member
5*a*: stepped portion of wrinkle pressing member
6: paper sheet
6*a*: blank
X: bottom member
Y: body member
d: gap between the distal end face of the wrinkle pressing member and the die top surface
α: approach angle of die 1
β: relief angle at the tip of punch 3

BEST MODE FOR CARRYING OUT THE INVENTION

The method of producing a molded paper body according to the present invention involves deep drawing a sheet of blank composed mainly of paper with a punch and a die, and uses a mechanism that holds and presses an outer peripheral portion of the blank between a wrinkle pressing member and a die top surface to apply an appropriate pressing force thereon during the deep drawing. The pressure applied by the wrinkle pressing member is correlated to the characteristic relationship between the proportion of pressure applied on wrinkles relative to the blank tensile strength and the height at which wrinkling starts whereby an appropriate range, at which wrinkling starts at a height exceeding a threshold ω, is worked out.

The molded paper body of the present invention can be used as the bottom part of a two-piece paper container having a body member and a bottom member. The bottom member is formed by punching out a blank from a paper sheet and deep drawing the blank. The thus formed bottom member is inserted into a tubular body member and bonded to the side wall of the body member, to form a paper container. A lower end portion of the body member may be folded inwards and fused to the bottom member by applying heat and pressure. Here, it is crucial that no gaps or pockets are present near the joint between the side wall of the bottom member and the body member on the side of the contents. The bottom member according to the present invention has a smooth surface near the side wall that stands up from the bottom so that there are no cavities between itself and the body member when bonded thereto, and can exhibit good adhesion.

The die that engages with the punch used in the deep drawing has a distal end shape with a radius of curvature R of 2.5 t to 6 t (t: blank thickness). This is based on a finding that, if it is less than 2.5 t, stress is concentrated at the distal end and the blank may be ruptured, while, if it is more than 6 t, wrinkling occurs. The reason why wrinkles appear if the distal end of the die has a large radius of curvature R is because the distance from the pressed-down portion to the punch is large and the blank is released too early from the wrinkle pressing force. Molded paper bodies with a similarly smooth surface can be obtained also in a case where processing is implemented under the same conditions as those of the present invention specified in Table 1 to be described later, even without ironing processing of the blank.

The method of pressing wrinkles will be described below with reference to FIG. 1. As long as a desired level of pressure is applied at an initial stage of the deep drawing process, the method is not limited to the example below. To be specific, a wrinkle pressing member 5 stays a constant distance from the upper surface of the die 1 and applies a constant pressure. The distance between the upper surface of the die 1 and the wrinkle pressing member 5 is set smaller than the blank thickness t, and means for adjusting the bottom dead center of the wrinkle pressing member is provided so that the distance is kept constant. Air cylinders or springs may be employed as pressure application means of the wrinkle pressing member.

The wrinkle pressing member 5 also has means for preventing pressure from being excessively applied by upwardly changing the distance between the distal end face of the wrinkle pressing member and the die upper surface in order to accommodate for an increase in the thickness of the outer peripheral portion of the blank which occurs as the diameter of the blank is reduced during the deep drawing process. According to the present invention, even if the original thickness of the blank is larger than the predictable range, an undesirable situation in which a pressure more than the predicted level is applied to the periphery of the blank 6*a* can be avoided, so that pressure is stably applied on wrinkles.

To form paper container bottoms, a paper sheet 6 is cut into a predetermined shape with a blanking die 2 and a blanking punch 4, after which the wrinkle pressing member 5 lowers down, and at the same time the punch and die move relative to each other to deep draw the blank into the shape of a bottom member. The thus formed bottom member is inserted into a tubular body member, although not shown, and bonded to the side wall of the body member, to form a paper container.

Although not shown, the blanking punch 4 has means for stopping it from moving further downwards. To reliably apply pressure on wrinkles in the peripheral portion of the blank 6*a*, as shown in the lower left of FIG. 1, distance D1 between the die 1 and the blanking punch 4 is set larger than distance D2 between the die 1 and the wrinkle pressing member 5 (D1>D2). The wrinkle pressing member 5 also has means for stopping it from moving further downwards (in the example here, the engagement between a stepped portion 4*a* of the blanking punch 4 and a stepped portion 5*a* of the wrinkle pressing member 5), so that the gap between the wrinkle pressing member and the top surface of the die is adjustable.

Figure 2A:
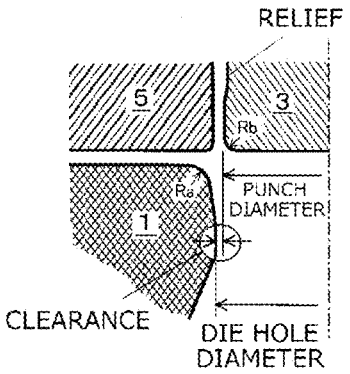
FIG. 2A and FIG. 2B are diagrams for explaining the shapes of the die and punch according to the present invention.

Next, the shapes of the die and punch will be described. Referring to FIG. 2A, the radius of curvature Ra on the punch facing side of the die 1 is set to 2.5 t to 6 t, where t is the thickness of the blank 6*a*. The radius of curvature Rb at the distal end of the punch 3 is set to 0.3 t to 6 t. The clearance between the die 1 and punch 3 should preferably be the difference (CL) between the minimum inside diameter of the die 1 and the maximum outside diameter of the punch 3, so that the ironing rate (red) expressed by $\{(t-CL)/t\}\times 100$ will be 20 or less. The outer circumferential surface continuing from the distal end of the punch 3 is tapered to provide a relief so that the outer peripheral edge of the blank 6*a* will not be ironed. This is to prevent generation of paper powder, which will occur if the outer peripheral edge is ironed.

Figure 2B:
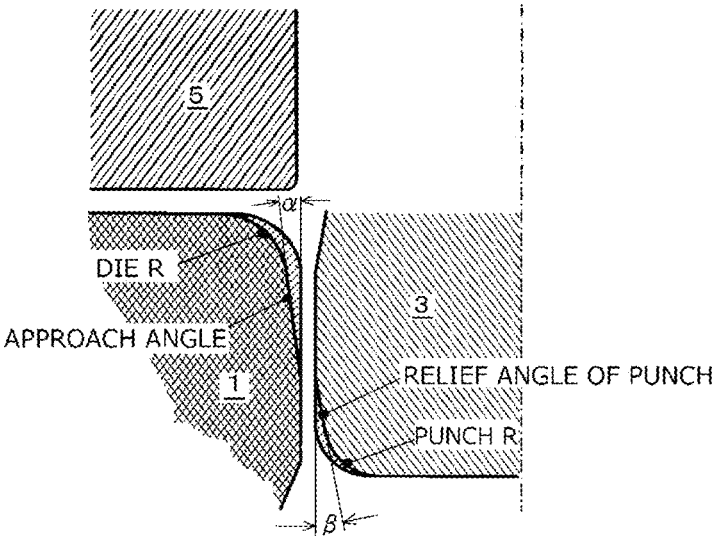

FIG. 2B shows the shapes of the punch facing side of the die 1 and the distal end of the punch 3 with two lines. The inside line shows the shape with an approach angle, which is given for making the pressure application more gradual during the deep drawing process. The range of approach angle is from 0.1° to 5°, and more preferably from 0.5° to 2°. The angle ranges noted above apply also to the relief angle β at the tip of the punch. The ironing allows the upright portion standing from the bottom to be almost vertical, and reduces the springback of the outer peripheral portion of the blank.

The blank 6*a* is cut out from the paper sheet 6 made of base paper laminated on each side with polyolefin. The blank may have multi-layered laminations including intermediate layers of polyolefin, EVOH, inorganic deposited film, organic coated film, aluminum foil, and the like.

EXAMPLES

The molded paper body of the present invention was prepared using the forming apparatus described below. The left half of FIG. 1 illustrates the state after the blanking, while the right half illustrates the state during formation of the bottom member. In the lower right part is a partial enlarged diagram illustrating a processed portion of the bottom member being formed. The blanking punch 4 displaces and cooperates with the die 2 to punch out a circular blank 6*a* from the sheet 6 that is mainly made of paper. The wrinkle pressing member 5 is disposed on the inner side of this blanking punch 4; it is ring-like, and its distal end face is generally curved outward, i.e., flat from the center inwards but mildly inclined in the outer peripheral portion that adjoins the blanking punch 4 as shown in the enlarged view in the lower left of the drawing. The wrinkle pressing member 5 is formed with a stepped portion 5*a* that is formed to be able to engage with a stepped portion 4*a* formed on the inner side of the blanking punch 4, so as to secure a limit to the gap D2 between the die 1 and the wrinkle pressing member 5, as well as to form a gap adjusting part, as the wrinkle pressing member 5 is configured to press the blanking punch 4 downwards from above with a predetermined pressure. Therefore, in a free state without any foreign substance in contact, the flat distal end face of the wrinkle pressing member 5 is located slightly lower than the lower end face of the blanking punch 4 (the difference being 0.05 mm in this example) as shown in the lower left part of the drawing. In the state after the blanking shown on the left side of FIG. 1, the lower end face of the blanking punch 4 is stopped at a height from the top surface of the die 1 by the original thickness of the blank 6*a* (equal to the thickness of the paper sheet 6 in this case), while the distal end face of the wrinkle pressing member 5 is pressing the surface of the blank 6*a*. With the distal end face of the wrinkle pressing member 5 pressing the peripheral portion of the blank 6*a* punched out into the circular shape, i.e., with a desired wrinkle pressing force being applied to the peripheral portion of the blank 6*a*, the punch 2 moves downward and cooperates with the die 1 to deep draw the blank 6*a* as shown on the right side of FIG. 1. It was found out that the wrinkle pressing force should be set within a predetermined desirable range that was specified through experiments as described below.

(Measurement of Wrinkle Pressing Force)

The tensile strength of the blank was determined as a force per unit area of the blank (MPa), which was obtained by dividing the value in accordance with the JIS standard (P8113) by the original thickness of the blank, and a proportion of the wrinkle pressing force in an initial processing stage relative to 100 of tensile strength of the blank was determined. The wrinkle pressing force was defined as a force per unit area (MPa).

Next, comparative data of a molded paper body made by a conventional forming method and a molded paper body made by the forming method of the present invention will be shown. The base paper with a basis weight of 200 g/m$^2$ and laminated on each side with polyethylene was used as the blank, and a paraffin-based lubricant was used during forming. The lubricant is one that is commonly used for paper cups. A spring mechanism was employed for the mechanism that allows displacement of the pressing member relative to the top surface of the die 1 while a predetermined pressure is being applied to the outer peripheral portion of the blank 6*a*.

These working conditions are listed up in Table 1. Other conditions were set the same.

TABLE 1

| Working Conditions | | Present Invention | Conventional Product |
|---|---|---|---|
| Forming Method | | Deep Drawing and Ironing | Deep Drawing |
| Wrinkle Compression | | Constant Pressure | Constant Gap |
| Blank Tensile Strength(MPa) | | 30 | 30 |
| Blank Diameter(mm) | | ϕ65 | ϕ65 |
| Blank Thickness(mm) | | 0.35 | 0.35 |
| Relationship between Wrinkle Pressing Member and Die Top Surface | Clearance(mm) | 0.3 | 0.90 |
| | Proportion to Blank Thickness(%) | — | 260 |
| | Pressure (MPa) | 1.8 | — |
| Proportion of Pressure on Wrinkles Relative to Blank Tensile Strength (%) | | 6 | — |
| Die | Die Hole Diameter (mm) | ϕ47.1 | ϕ47.1 |
| | Radius of Curvature | R1 | R3 |
| | Approach Angle (°) | 1 | none |
| Punch | Punch Outside Diameter(mm) | ϕ46.47 | ϕ46.4 |
| | Radius of Curvature | R0.2 | R0.2 |
| | Punch Relief Angle (°) | 1 | none |
| Relationship between Punch Outside Diameter and Die Hole Diameter | Clearance(mm) | 0.315 | 0.350 |
| | Ironing Rate(%) | 10 | 0 |

Figure 3A:
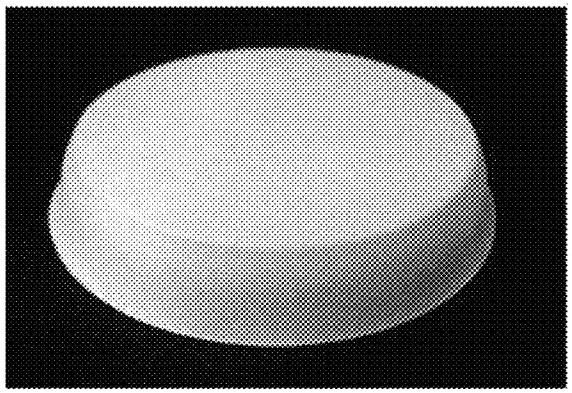
FIG. 3A to FIG. 3E are an outer appearance image and microscopic structural views of a bottom member made by the molded paper body forming method according to the present invention.
Figure 3B:
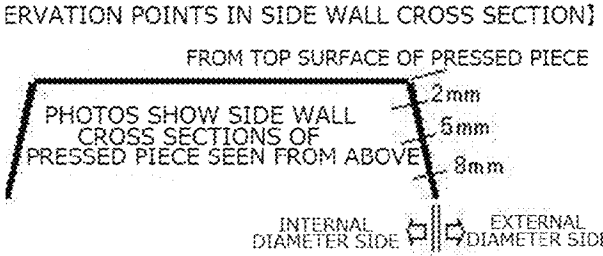
Figure 3C:
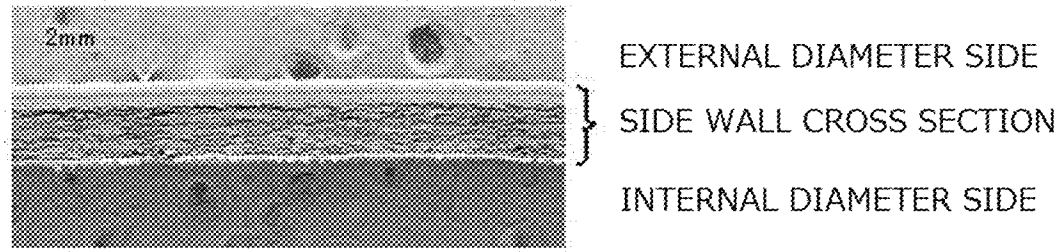
Figure 3D:
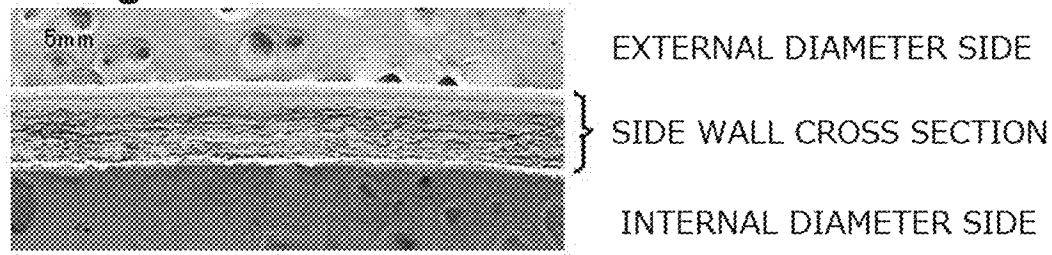
Figure 3E:
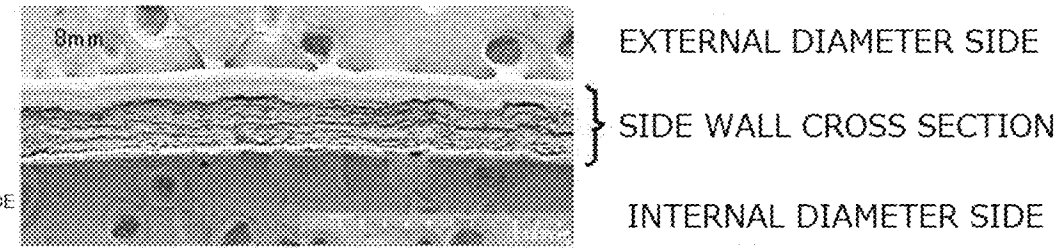
Figure 4A:
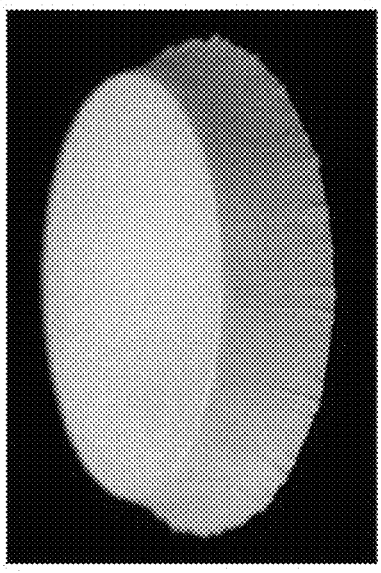
FIG. 4A to FIG. 4E are an outer appearance image and microscopic structural views of a molded paper body made by a conventional forming method.
Figure 4B:
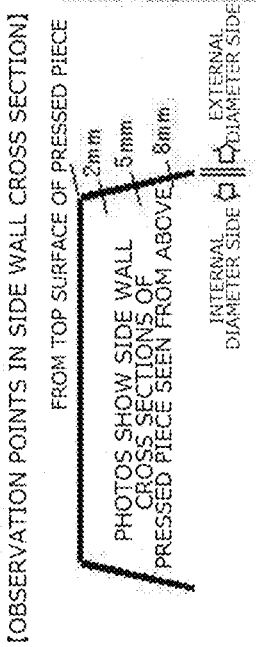
Figure 4C:
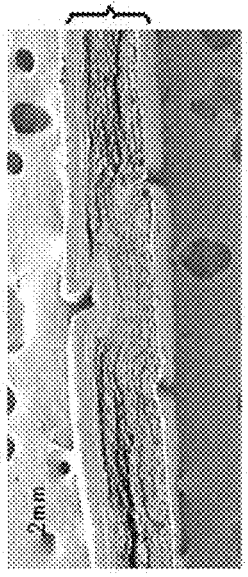
Figure 4D:
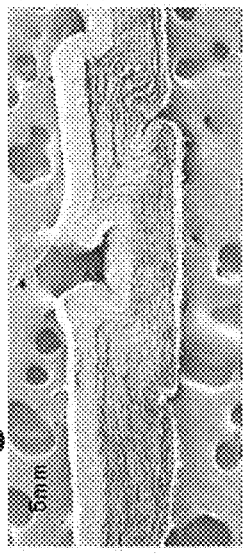
Figure 4E:
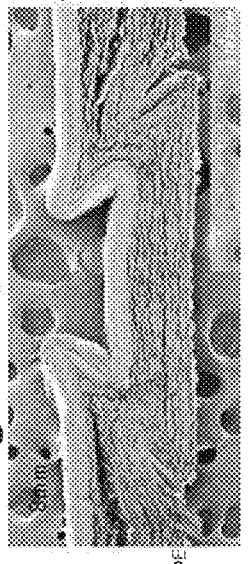

The microscopic structures of the molded paper bodies made under the working conditions listed above were as shown in FIG. 3A to FIG. 3E and FIG. 4A to FIG. 4E. FIG. 3A to FIG. 3E show the molded paper body made in accordance with the present invention and FIG. 4A to FIG. 4E show the molded paper body made in accordance with the conventional method. FIG. 3A and FIG. 4A are photographic images of the outer appearance, FIG. 3B and FIG. 4B are diagrams illustrating the observed portions of the microscopic photographs, FIG. 3C and FIG. 4C show the microscopic structures at 2 mm height from the bottom, FIG. 3D and FIG. 4D show the microscopic structures at 5 mm height from the bottom, and FIG. 3E and FIG. 4E show the microscopic structures at 8 mm height from the bottom. A comparison between the microscopic structures at 2 mm height from the bottom in FIG. 3C and FIG. 4C indicates that small dents (hollows) are formed in the base paper f the body made by the conventional method. The dents at 5 mm height and 8 mm height are larger, and wrinkles are clearly visible from the photographic image of the outer appearance in FIG. 4A. The thickness of the bottom member is also gradually larger at 5 mm height and 8 mm height. In contrast, not even small dents are observable in the base paper of the body according to the present invention, not only in the microscopic structure at 2 mm height from the bottom but also in the microscopic structures at 5 mm height and 8 mm height. There can be found no visible wrinkles in the photographic image of the outer appearance in FIG. 3A. The thickness of the bottom member is substantially uniform. It was confirmed that there were distinct differences between the molded bodies made in this comparison test.

Figure 5:
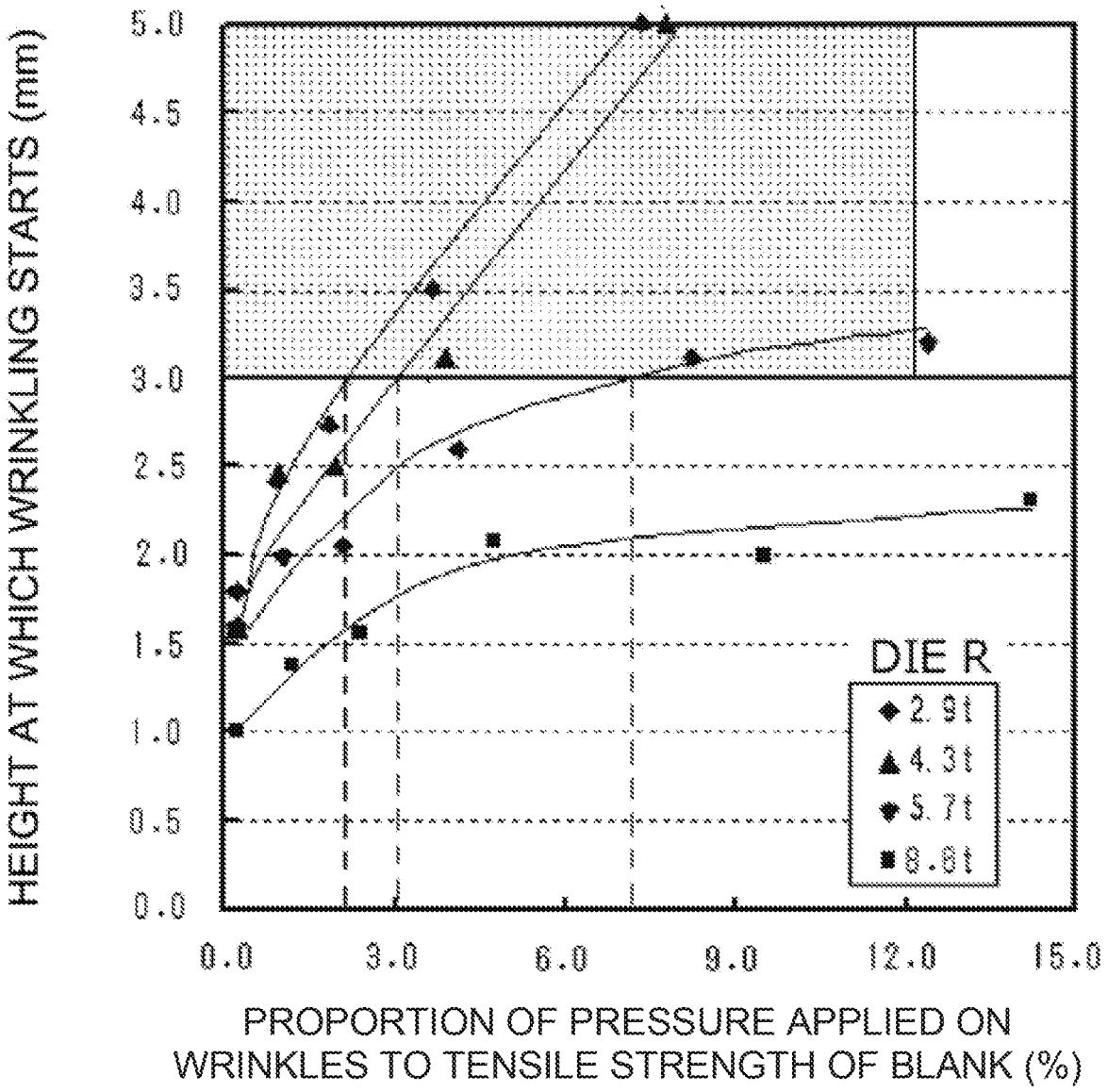
FIG. 5 is a graph showing the characteristic relationship between the proportion of pressure applied on wrinkles relative to the tensile strength of the blank and the height at which wrinkling starts.

Next, the relationship between the proportion of pressure applied on wrinkles relative to the tensile strength of the blank and the height at which wrinkling starts was investigated. Molded paper bodies were prepared under the conditions similar to those shown in Table 1 with the use of the blank mentioned above except that the wrinkle pressing force and die shape were changed. The heights at which wrinkling starts (wrinkling height) were determined by visually observing the positions of wrinkles in a radially outward direction in the portion standing up from the bottom. FIG. 5 shows the results. The characteristics of four types of dies with radii of curvature R of 2.9 t, 4.3 t, 5.7 t, and 8.6 t were determined. Resultant products in which wrinkles appeared at or above a threshold height of 3 mm were determined as good. Namely, a product in which wrinkles appear at or above 3 mm height are considered to be the molded paper body that achieves the object of the present invention. Here, the threshold ω is 3 mm. As can be seen from the results shown in the drawing, the larger the radius of curvature R of the die, the more gentle the gradient of the die characteristics. It can be seen that no good products will be obtained in which wrinkles appear at or above the threshold height of 3 mm with the use of the die having an R value of 8.6 t. Conversely, if the radius of curvature R of the die is too small, the effect of rounding the tip of the die will be reduced, and the risk of rupture of the blank due to a higher local stress during the process will increase. It was ascertained that the appropriate range was from 2.5 t to 6 t. It can also be seen from the results shown in the drawing that if the proportion of the wrinkle pressing force relative to the tensile strength of blank was too small, wrinkle height would be 3 mm at most. If the proportion of the wrinkle pressing force relative to the tensile strength of blank is too large, the risk of blank rupture will increase. The appropriate range was ascertained to be 12% or less. The dotted area in FIG. 5 indicates the appropriate range. Namely, in accordance with the present invention, the wrinkle pressing force is set appropriately, based on a characteristic relation of dies between a proportion of the wrinkle pressing force relative to the blank tensile strength and wrinkle start height, to the appropriate range that is from at least a proportion of the wrinkle pressing force, with which wrinkling start height exceeds a threshold of 3 mm, to the threshold at 12% or lower. To be specific, the appropriate range is from 2% to 12% with a die having an R value of 2.9 t, from 3% to 12% with a die having an R value of 4.3 t, and from 6.7% to 12% with a die having an R value of 5.7 t.

The value 8.6 t was obviously inappropriate as the radius of curvature R of the die, and an appropriate range was determined to be from 2.5 t to 6 t.

Figure 10:
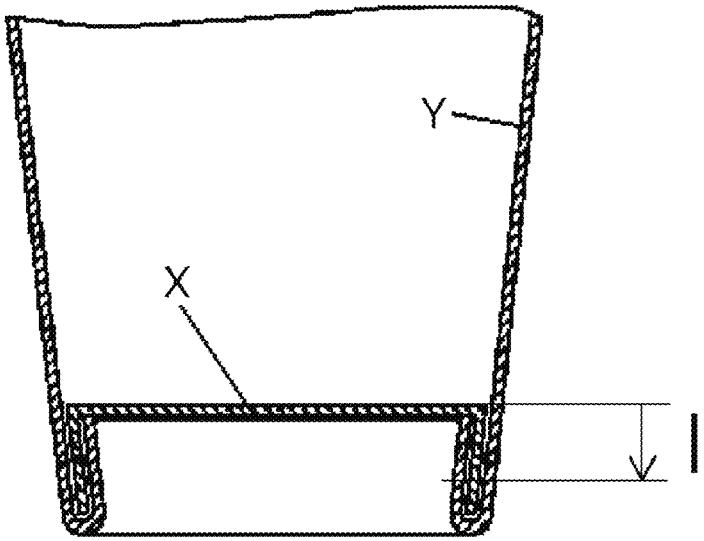
FIG. 10 is a diagram for explaining the structure of the bottom part of a two-piece paper cup.

Next, paper containers were prepared by inserting the molded paper bodies of the present invention made under the conditions of Table 1 into a tubular body member, folding back the bottom edge of the body member inwards over the outer peripheral edge of the molded paper body that forms the bottom member, and bonding the lower end of the body member with the bottom member by applying heat and pressure. Conventional product A and conventional product B are commercially available containers for long-life use and short-life use (for storage period of about 2 weeks), respectively. Each container was cut at a distance 1 as shown in FIG. 10 of 2 mm, 3 mm, 4 mm, and 6 mm from the bottom, and microscopic photographs of the sections were taken to measure the hollow depth. Gray or dotted shading over the measurement values indicates that no wrinkles were visually perceptible. Table 2 shows the results.

(Measurement of Hollow Depth)

Each paper container was cut at respective upright positions from the bottom and optical microscopic photographs of the horizontal cross sections were taken. The depth a of hollows in the vertical direction from the base paper surface of the bottom member was measured. The hollow depth is expressed as follows by proportion (%), with the thickness of the paper container bottom that corresponds to the base paper thickness of the blank being 100% (see FIG. 8):

Hollow depth=Hollow depth a (mm)/base paper thickness of blank (mm)×100.

unit: %

| Container | | Thickness of Bottom Sheet (mm) | Distance from Bottom (mm) | Sample 1 | Sample 2 | Sample 3 | AVE | MAX | MIN |
|---|---|---|---|---|---|---|---|---|---|
| Long-life | Present Invention | 0.231 | 2 | 17* | _* | 13* | 15 | 17 | 13 |
| | | | 3 | 26* | 17* | 26* | 23 | 26 | 17 |
| | | | 4 | 26* | 30 | 35 | 30 | 35 | 26 |
| | | | 6 | 43 | 26* | 35 | 35 | 43 | 26 |
| | Conventional Product A | 0.236 | 2 | 17* | 51 | 47 | 38 | 51 | 17 |
| | | | 3 | 64 | 81 | 81 | 75 | 81 | 64 |
| | | | 4 | 59 | 97 | 102 | 86 | 102 | 59 |
| | | | 6 | 89 | 148 | 153 | 130 | 153 | 89 |
| Short-life | Conventional Product B | 0.275 | 2 | 55 | 62 | 40 | 52 | 62 | 40 |
| | | | 3 | 80 | 73 | 62 | 72 | 80 | 62 |
| | | | 4 | 65 | 76 | 65 | 69 | 76 | 65 |
| | | | 6 | 73 | 73 | 95 | 80 | 95 | 73 |

An asterisk (*) indicates that visual verification of hollows was difficult.

Figure 6:
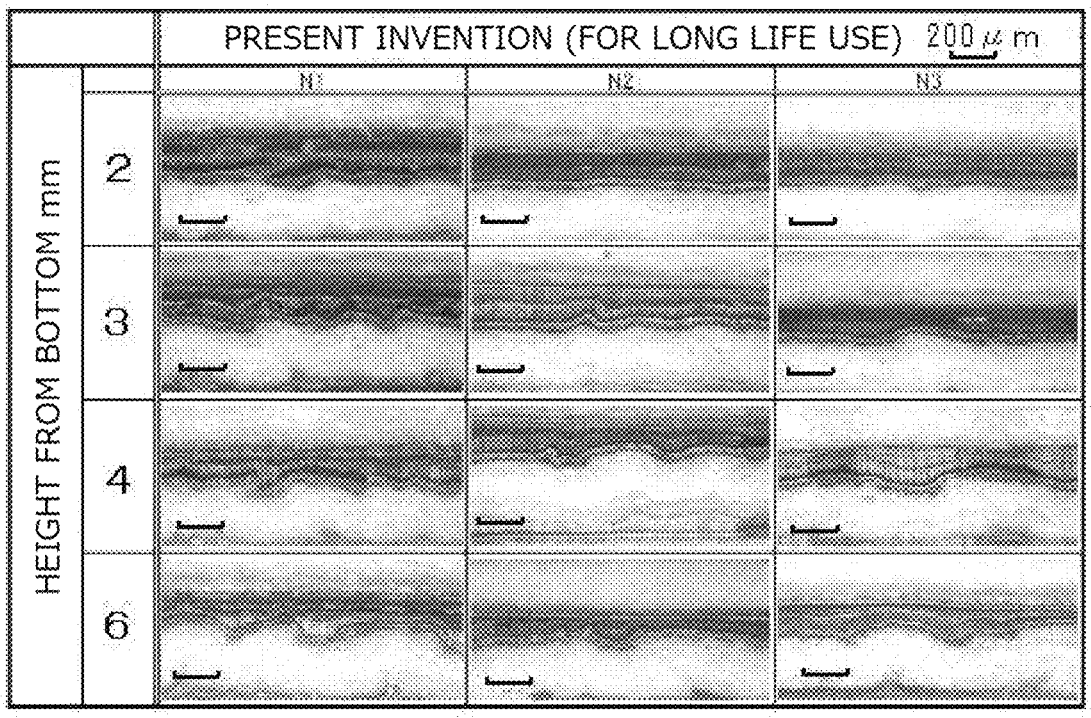
FIG. 6 shows microscopic photographs of cross sections of wrinkles in the bottom of the deep drawn, molded paper body of the present invention.
Figure 7:
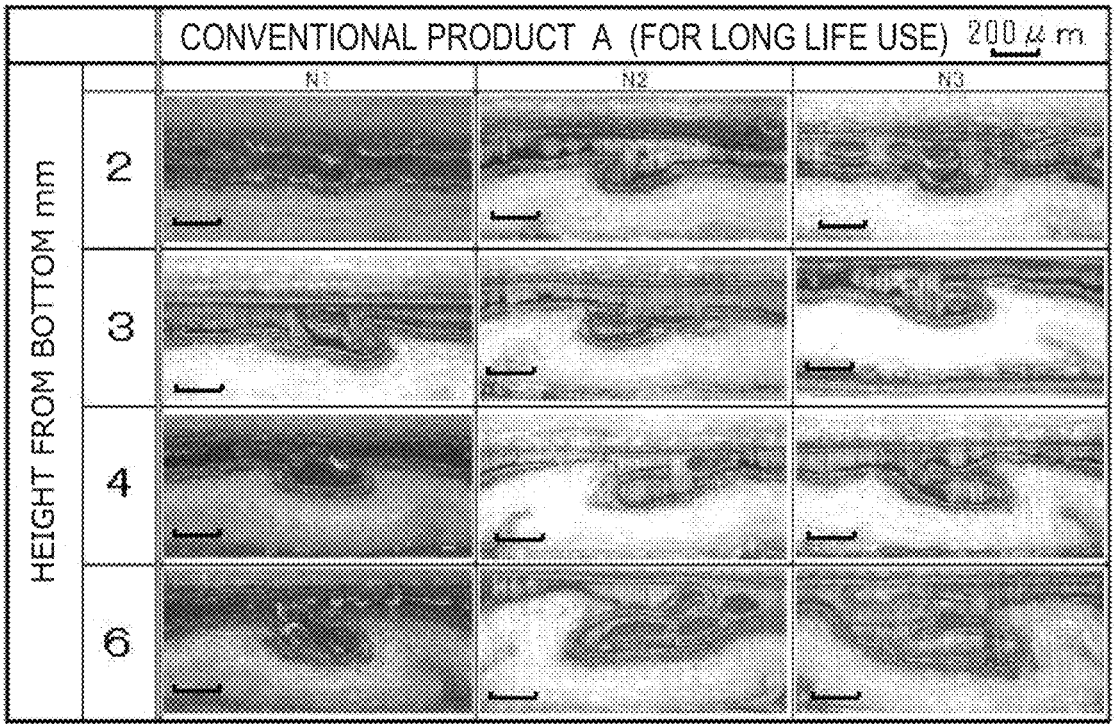
FIG. 7 shows microscopic photographs of cross sections of wrinkles in the paper container bottom of deep drawn Conventional Product A.
Figure 8:
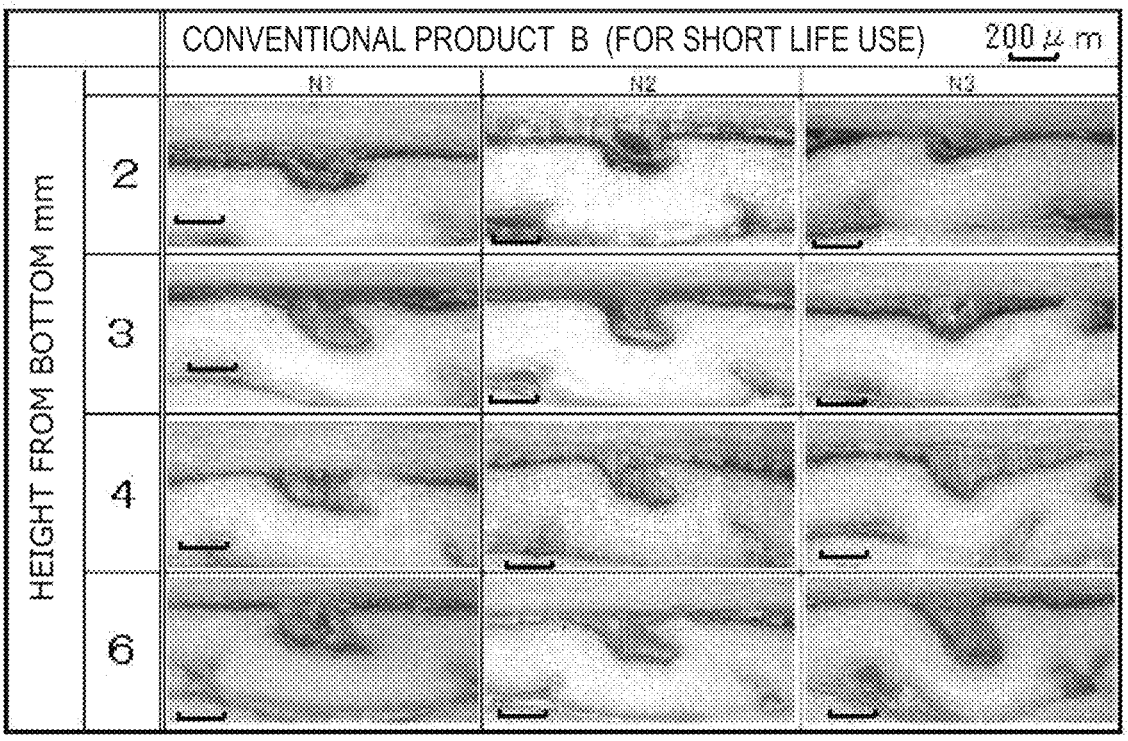
FIG. 8 shows microscopic photographs of cross sections of wrinkles in the paper container bottom of deep drawn Conventional Product B.
Figure 9:
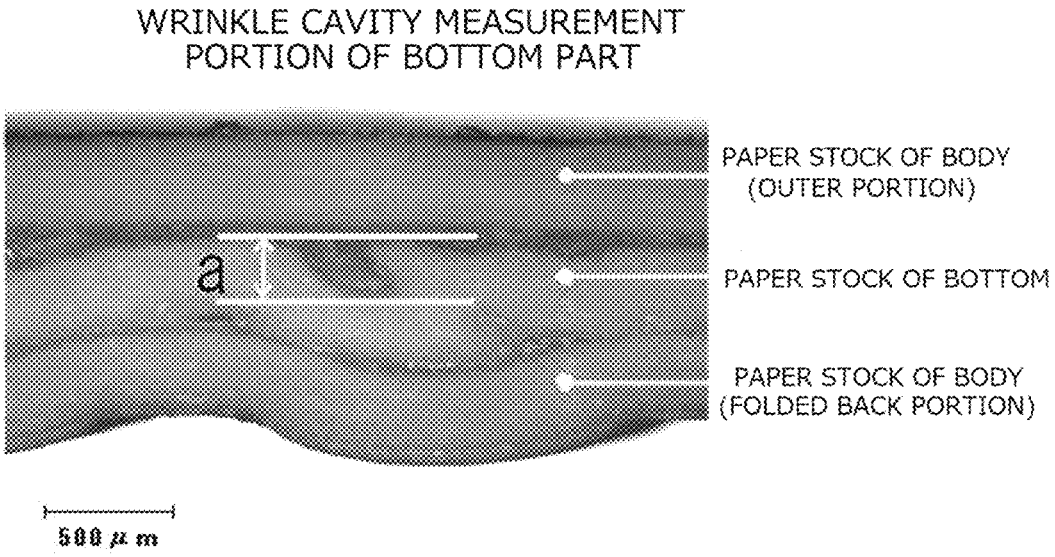
FIG. 9 is a diagram for explaining measurement of hollows.

The microscopic photographs show the cross section of the bottom member sandwiched between the folded back body member as illustrated in FIG. 9. The height of hollows of the wrinkles formed during deep drawing of the bottom piece, which is the object of the present invention, was measured as a dimension a in the thickness direction as shown in the drawing. The photographs shown in FIG. 6 to FIG. 8 show the cross sections of trimmed regions of wrinkles. A white area in the upper part of the photograph is the base paper of the outside body member, the lower part is the base paper of the bottom member, and the middle part is the adhesive layer of fused polyethylene lamination. The line segment in each photograph indicates a dimension of 200 μm.

No visible wrinkles formed within 3 mm from the bottom in the containers of the present invention shown in FIG. 5, which confirmed that they had a smooth surface. Even the maximum depth of hollow at 6 mm height was 43%. As can be seen from the photographs, no air bubbles (cavities) are present in the adhesive layer that adjoins the body member. The variation rate among the samples was also small, it being 4% at 3 mm height and 17% even at 6 mm height. The containers can thus store liquid contents reliably without leakage and withstand a long-term use satisfactorily. The key issue here is that there are no wrinkles particularly in portions near the bottom. The data shows that the paper containers can withstand long-life use.

FIG. 7 shows microscopic photographs comparing three samples (N1, N2, and N3) of Comparative Product 1 that are currently distributed paper containers for long-life use. The photographs show clearly visible hollows as well as cavities in the adhesive layer that adjoins the body member. As the photographs of each row show the portions at the same circumferential position at different heights, it can be seen that the cavity is vertically continuous. Such a cavity can cause leaks, as well as lead to critical issues of disinfectant residue there or bacteria remaining there due to incomplete sterilization. The measurements indicate that the average depth at 3 mm height from the bottom is 75%, which is largely different from 15% in the case with the present invention. The average depth of hollows at 2 mm height is 38%. The average depth of hollows at 6 mm height is 130%, which indicates that the wrinkles in this portion are fairly large. The variation rate among the samples was 17% at 3 mm height and as large as 64% at 6 mm height.

Hollows of wrinkles are clearly visible, as well as cavities here and there, from any of the photographs of Conventional Product B shown in FIG. 8. The average depth at 3 mm height from the bottom is 72%, which is largely different from 23% in the case with the present invention. The average depth of hollows at 2 mm height is 52%, while the average depth of hollows at 6 mm height is 80%, which indicates the tendency of gradual increase from the bottom, although it shows that there is no large difference in the depth of the wrinkles in the up and down direction. In portions from the bottom to 3 mm height, the average depth is 52% and 72% at 2 mm height and 3 mm height, respectively, which confirms the presence of wrinkles.

As described above, the products in accordance with the present invention have excellent surface conditions after the forming process as compared to conventional products. Unlike conventional products, firstly, there are no visible wrinkles, which obviously gives a fine appearance to the finished product, and also enables a reliable bond to be formed with another component such as a body member without cavities or the like in the adhesive layer. As the hollows are smaller even in the outer peripheral portion of the blank which is structurally densest, a good bond can be achieved also in the height direction, and as there are no cavities, a desirable paper container that can withstand long-life applications can be provided.

INDUSTRIAL APPLICABILITY

Although the invention has been described herein with respect to an example of forming the bottom part of a paper container such as a paper cup, the invention is not limited to the bottom part of two-piece paper containers but may also be applied to one-piece paper containers with side walls of a small height such as paper dishes or paper trays. The molded paper body or paper container of the present invention may contain drinks such as milk, milk for use in portions, coffee, or food products such as jam, yogurt, cheese, butter, ice cream, or snack food.

What is claimed is:

1. A method of producing a molded paper body, comprising: deep drawing a sheet of blank comprising paper, with a punch and a die, holding an outer peripheral portion of the blank by pressing with a wrinkle pressing member and an upper surface of the die to thereby form the molded paper body, wherein the molded paper body has a top surface and a sidewall, wherein the pressing with the wrinkle pressing member is performed such that (i) wrinkles are not formed in the molded paper body in an area of the sidewall from the top surface to a position which is 3 mm from the top surface, and (ii) a proportion of the pressing force applied by the wrinkle pressing member in an initial processing stage to the tensile strength of the blank is 2% to 12%, wherein an end of the die which is nearest to the punch has a rounded shape, with a radius of curvature R being 2.5 t to 6 t, where t is the thickness of the blank.

2. The method of producing a molded paper body according to claim 1, wherein the pressing is performed by the wrinkle pressing member that is at a predetermined distance from the upper surface of the die with a predetermined force.

3. The method of producing a molded paper body according to claim 1, wherein a distance between a lower face of the wrinkle pressing member, at a radially outermost position of the wrinkle pressing member, and the upper surface of the die is set to a predetermined value d that is equal to or larger than a thickness t of the blank.

4. The method of producing a molded paper body according to claim 1, wherein the die has an approach angle of 0.1° to 5°, and wherein a clearance CL between an inner circumferential surface of the die and an outer circumferential surface of the punch is set such that a value of $\{(t-CL)/t\}\times 100$ is 20 or less.

5. The method of producing a molded paper body according to claim 1, wherein an outer circumferential surface of the punch, which continues to an end of the punch which is nearest to the die, is tapered to provide a relief so that the outer peripheral portion of the blank is not ironed at an edge thereof.

* * * * *